US006245117B1

(12) United States Patent
Nishikawa et al.

(10) Patent No.: US 6,245,117 B1
(45) Date of Patent: Jun. 12, 2001

(54) MODIFIER OF CELLULOSE FIBERS AND MODIFICATION METHOD OF CELLULOSE FIBERS

(75) Inventors: Sadahiko Nishikawa; Shigenobu Fujita; Kazuhide Tsuji, all of Hyogo (JP)

(73) Assignee: Ipposha Oil Industries Co., Ltd., Hyogo (JP)

( * ) Notice: Subject to any disclaimer, the term of this patent is extended or adjusted under 35 U.S.C. 154(b) by 0 days.

(21) Appl. No.: 09/363,232

(22) Filed: Jul. 22, 1999

(30) Foreign Application Priority Data

Aug. 7, 1998 (JP) ..... 10-223967
Apr. 1, 1999 (JP) ..... 11-094958

(51) Int. Cl.[7] ..... D06M 13/11; D06M 13/325; D06M 11/38

(52) U.S. Cl. ..... 8/116.1; 8/181; 8/120; 8/125

(58) Field of Search ..... 8/116.1, 181, 120, 8/125, 611, 614, 612

(56) References Cited

U.S. PATENT DOCUMENTS 4,049,851 9/1977 Greif et al. .
4,246,221 * 1/1981 McCorsley, III .
5,395,516 * 3/1995 Gray .
5,561,739 10/1996 Urben .

FOREIGN PATENT DOCUMENTS

1272880 * 7/1968 (DE) .
894 195 4/1962 (GB) .
1 034 606 6/1966 (GB) .
6-322667 11/1994 (JP) .
9-137384 5/1997 (JP) .

* cited by examiner

*Primary Examiner*—Margaret Einsmann
(74) *Attorney, Agent, or Firm*—Merchant & Gould P.C.

(57) ABSTRACT

A compound A expressed by the following chemical formula (wherein R denotes an organic group including a hydrocarbon group, an alkanolamine group, an aromatic group and/or a group including a polyoxyalkylene adduct; m denotes a positive integer of 0 to 3 and can be represented by a plurality of values; and k denotes a positive integer of 2 to 6) and containing a chlorohydrin group at its terminal is brought into contact with cellulose fibers in an aqueous phase in the presence of an alkali metal compound so that the cellulose fibers are crosslinked at the molecular level. Thus, the crosslinking reaction occurs on the surface of the cellulose fiber, and the anti-fibrillation effect and deep dyeing effect can be obtained without damaging the soft feeling of the cellulose fiber.

(Compound A)

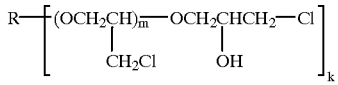

9 Claims, No Drawings

MODIFIER OF CELLULOSE FIBERS AND MODIFICATION METHOD OF CELLULOSE FIBERS

FIELD OF THE INVENTION

The present invention relates to a modifier of cellulose fibers and a modification method of cellulose fibers. More specifically, the present invention relates to an anti-fibrillation agent or a deep dyeing agent for modifying cellulose fibers without damaging the softness and to a deep dyeing pretreatment method. Moreover, the term fiber used in the present invention widely includes cottons, tows, yarns, woven fabrics, knitted fabrics, nonwoven fabrics and fiber products.

BACKGROUND OF THE INVENTION

Hitherto, cellulose fibers, for example, cotton fibers; regenerated cellulose fibers such as viscose rayon (rayon, polynosic, polyviscose, etc.), cuprammonium rayon (Cupra), refined cellulose fibers (for example, Tencel which is solvent-spun cellulose produced by Courtaulds Fibers (UK)), etc.; semisynthetic cellulose fibers such as cellulose acetate (acetate, diacetate, triacetate) fibers, promix (polyacrylonitrile-milk protein graft fiber), etc.; linen fibers; or the like, easily undergo fibrillation. The fibrillation herein denotes a phenomenon in which microfibers forming one fiber are split in the length direction of the fiber. The fibrillation causes whitening of the fiber, thus deteriorating the quality of the fiber. Methods for effectively preventing the fibrillation have not been a suggested to date.

In particular, the refined cellulose fiber has fiber strength stronger than that of rayon and a soft feeling peculiar to rayon. However, since the refined cellulose fiber has a single fiber structure having a uniform and dense fiber cross section instead of a skin-core structure, it is easily fibrillated. The recent researches and developments of the refined cellulose fibers have focused on anti-pilling technologies. Among the refined cellulose fibers, in the refined cellulose fiber in which the fiber surface is intentionally fibrillated by a crumpling and pounding process and then the fibrillated fibers are melted and removed by a cellulase process, pilling hardly occurs. Such a refined cellulose fiber has a feeling of a so-called peach skin finish fabric, and is evaluated as a fiber material suitable for the purpose of the fashion aspect JP 6-322667.

However, the above-mentioned method has problems, for example, the thinning of fibers and a long duration and complicated operation. Thus, it is not a sufficient method because it may deteriorate the strength, or it may lead to the poor operation efficiency. Furthermore, although the peach skin finish fabric may be suitable for the purpose of fashion, it is not suitable for the general-purpose. Thus, the application of the use and using method are limited.

In such circumstances, many methods for preventing the fibrillation by chemically treating fibers have been suggested. Examples of such methods include a method of treating fibers with a bifunctional aldehyde based treating agent (see Publication of JP No. 8-49167 A), a method of treating fibers with diglycidyl ether based treating agent (see Publication of JP No. 9-137384 A), or the like.

In such methods, however, as in usual resin processing methods, the softness of fibers is deteriorated and the fibers cannot practically be used. Furthermore, unevenness in dyeing easily occurs.

Furthermore, a reactive dye, a direct dye, a vat dye, a sulphur dye, a naphthol dye, or the like, is used for dyeing the cellulose fibers. However, each dye has its own effective dye uptake. In general, the dyeing concentration beyond the concentration when the dyeing site of each fiber is dyed cannot be expected. The reactive dyeing achieved by ion bonding (for example, dyeing of nylon and wool with acid dye, dyeing of acrylic fibers with basic dye) has an excellent dyeing efficiency. However, the dyeing efficiency of a reactive dye that reacts with cellulose fiber by covalent bonding is inferior to that by ion bonding. In addition, the dyeing efficiencies of the direct dye, the vat dye, the sulphur dye and the naphthol dye, which bond to cellulose fibers by hydrogen bonding and Van der Waals force, have poorer dyeing efficiency than that by ion bonding, although it is not so poor as the case of the reactive dye. The deterioration of the dyeing efficiency is significantly shown in the case of the deep dyeing. In particular, since the reactive dye uses the most strong and stable chemical bonding, i.e. covalent bonding, it has an excellent wet color fastness. Furthermore, since the reactive dye permits wide range of dyeing in terms of color tone, the consumption of the reactive dye is the greatest in all other dyes used for cellulose fibers. However, the reactive dye has a problem in dyeing efficiency. It is a big challenge to improve the efficiency in dyeing cellulose fibers by direct dyes.

SUMMARY OF THE INVENTION

It is therefore a first object of the present invention to provide an agent of preventing the fibrillation without damaging the softness of the cellulose fibers and a method therefor.

It is a second object of the present invention to provide a dyeing agent capable of obtaining a deep dyeing effect by improving the efficiency in deep dyeing cellulose fibers and a deep dyeing pretreatment using the same.

In order to achieve the above-mentioned objects, the modifier of cellulose fibers of the present invention contains a chlorohydrin group at the terminal of a compound A expressed by the following chemical formula 3:

(Chemical Formula 3)

(Compound A)

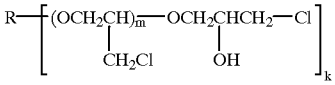

wherein, R denotes an organic group including a hydrocarbon group, an alkanolamine group, an aromatic group and/or a group including a polyoxyalkylene adduct; m denotes a positive integer of 0 to 3 and can be represented by a plurality of numerical values; and k denotes a positive integer of 2 to 6. Herein, the compound A expressed by the above-mentioned chemical formula may be a single compound or may be a mixture.

In the present invention, the modifier of the cellulose fibers is used as an anti-fibrillation agent or a deep dyeing agent. However, it can be used for the other objects within the scope of the purpose of the present invention.

It is preferable that the cellulose fiber is at least one selected from the group consisting of a cotton fiber, viscose rayon, cuprammonium rayon, a refined cellulose fiber, a regenerated cellulose fiber and a linen fiber. Of course, the modifier can be used for the other cellulose fibers within the scope of the purpose of the present invention.

The fixing amount of the modifier expressed by the above-mentioned chemical formula (compound A) with respect to the cellulose fiber is preferably in the range from 0.05 to 10 weight %, more preferably in the range from 0.1 to 8 weight %, and especially preferably in the range from 0.2 to 5 weight %. When the fixing amount is in the above-mentioned ranges, the modifier can contribute to both the anti-fibrillation and the deep dyeing.

It is preferable that the modifier expressed by the above-mentioned chemical formula (compound A) is an aqueous composition (e.g. emulsion) and the concentration of the chemical formula in the aqueous composition is 1 to 30 parts by weight with respect to 100 parts by weight of water. When the modifier is in a form of aqueous emulsion, it easily can be used for the modifying treatment of cellulose fibers. Furthermore, when the concentration is in the above-mentioned ranges, the modifier can contribute to both anti-fibrillation and deep dyeing.

The R of the chemical formula (compound A) is a hydrocarbon group that is a residue after glycerin, sorbitol and not more than a decamer of polyethylene glycols are reacted with each other; an alkanolamine group including a triethanolamine group or a diethanolamine group; and a cresol group, a bisphenol A group or a bisphenol S group. When R is the above-mentioned organic group, the modifier contributes to both the anti-fibrillation and the deep dyeing.

Next, the modification method of cellulose fibers is characterized in that the compound A expressed by the above-mentioned chemical formula is brought into contact with a cellulose fiber in an aqueous phase in the presence of an alkali metal compound, and then the cellulose fibers are crosslinked.

It is preferable that the above-mentioned modification method of cellulose fibers is an anti-fibrillation method or a deep dyeing method.

Furthermore, it is preferable in the above-mentioned method that the concentration of the compound A in an aqueous composition (e.g. emulsion) is 1 to 30 parts by weight with respect to 100 parts by weight of water. When the concentration falls in the above-mentioned range, the modifier contributes to both the anti-fibrillation and the deep dyeing.

Furthermore, in the above-mentioned method, the addition amount of the alkali metal compound is preferably 1 to 3 times moles, more preferably 1.1 to 2.5 times moles, with respect to the molar number of the chlorohydrin group positioned at the terminal of said compound A.

It is preferable that the above-mentioned method uses at least one method selected from the group consisting of an immersing method including a room temperature standing method and a heat stirring method; a padding method including a pad-roll method, a calendar method, an ink jet printing method, a pad dry cure method or a pad steam method; a textile printing method; a spray method; and a cold batch method.

Furthermore, it is preferable in the above-mentioned method that the alkali metal compound is an alkali metal hydroxide.

Furthermore, it is preferable in the above-mentioned method that the alkali metal hydroxide is at least one selected from the group consisting of sodium hydroxide (NaOH) and potassium hydroxide (KOH).

Since the above-mentioned anti-fibrillation agent of the present invention contains a chlorohydrin group, when it is brought into contact with the cellulose fiber in an aqueous phase in the presence of the alkali metal compound; first, the chloro group (—Cl) of the above-mentioned compound A approaches the —OH groups of the cellulose fiber, and then NaCl is removed by a desalination reaction of the alkali metal compound (e.g. NaOH); and then the above-mentioned compound A is chemically bonded (covalent bonding) to the cellulose fiber. Since the compound A includes two or more chlorohydrin groups in one molecule, the cellulose fiber is crosslinked by the compound A at the molecular structure level. Thus, the fibrillation can be prevented. Due to the above-mentioned crosslinking, —OH group of the compound A is placed in a place that is more distant from the cellulose fiber than the place of —OH group of the original cellulose fiber. Therefore, the affinity for a dye is increased, thus improving the dyeing efficiency. Consequently, the deep dyeing of cellulose fibers can be achieved.

As mentioned above, the present invention can provide a method of preventing the fibrillation without damaging the soft feeling of cellulose fibers by chemically treating the surface of the cellulose fiber by a crosslinking reaction.

Furthermore, according to another aspect of the present invention, the deep dying effect can be obtained in dyeing cellulose fibers by a pretreatment, that is, a chemical treatment to the surface of the cellulose fiber by a crosslinking reaction. Furthermore, evenly dyed materials can be obtained.

DETAILED DESCRIPTION OF THE INVENTION

Hereinafter, the present invention will be described in detail.

Examples of the cellulose fibers usable for preventing the fibrillation of the present invention include generated cellulose fibers such as viscose rayon (rayon, polynosic, polyviscose, etc.), cuprammonium rayon (Cupra, Bemberg, etc.), a refined cellulose fiber (for example, Tencel produced by Courtaulds Fiber (UK)), etc.; semisynthetic fibers such as cellulose acetate (acetate, diacetate, triacetate) fibers, promix (polyacrylonitrile-milk protein graft fiber), etc.; a cotton fiber, a linen fibers, or the like. Besides these examples, fibers including —OH group, for example, vinylon [$—(CH_2—CHOH)_n—$, wherein n denotes a positive integer to represent a repetitive unit number of the polymer] and polychlal [a copolymer of $—(CH_2—CHCl)_n—$ and $—(CH_2—CHOH)_n—$, wherein n denotes a positive integer to represent a repetitive unit number of the polymer], or the like, are usable.

R of the above-mentioned chemical formula (compound A) is a hydrocarbon group that is a residue after glycerin, sorbitol, and not more than a decamer of polyethylene glycols are reacted with each other; alkanolamines such as triethanolamine, diethanolamine, etc.; or an aromatic compound such as cresol, bisphenol A, bisphenol S, etc.

Furthermore, m denotes a positive integer of 0 to 3. In particular, a mixture having a 50 wt. % or more of a compound of m=0 as main component is preferable. Reference mark k is not particularly limited as long as it is 2 or more because it contributes to the crosslinking. However, practically, k is a positive integer of up to 6.

A method for preventing cellulose fibers from fibrillating by using the compound A is not particularly limited as long as it can advance a reaction of the compound A and alkali metal compound with a hydroxyl group of the cellulose fiber on the fiber surface so as to fix with each other. The compound A is an important factor of the present invention since the fibrillation effect depends upon the fixing amount of the compound A. The fixing amount is in the range from 0.05 to 10 weight %, preferably in the range from 0.1 to 8 weight %, and more preferably in the range from 0.2 to 5 weight %.

The practical treating method of the present invention is not particularly limited, and usual method may be used for treating fiber materials with the compound A. Examples of treating methods include an immersing method such as a room temperature standing method and a heat stirring method; a padding method such as a pad-roll method, a calendar method, an ink jet printing method, a pad dry cure method or a pad steam method; a textile printing method; a spray method; a cold batch method; and the like.

Moreover, the form of the cellulose to be treated in the present invention is not particularly limited. Examples of such cellulose forms include raw cotton, tow, fiber, yarn, knitted fabric, non-woven fabric, etc.

The alkali used herein denotes a hydroxide of an alkali metal or alkaline compound of carbonate, etc. For example, sodium hydroxide, potassium hydroxide, sodium carbonate, potassium carbonate, etc. preferably can be used. Hydroxide of alkali metal is more preferred.

In any case, it is preferable that the inside of the fiber materials is well impregnated with a treating agent.

Therefore, it is of course effective that the treating agent is used in combination with a penetrating agent, a solvent, a thickener, etc., or that the treating agent is heated in use. However, care should be taken when using a compound that bonds to the compound A so as to produce dissoluble products.

When the compound A cannot be water soluble due to the structure of R, it is made to be a form of an aqueous emulsion. In this case, an emulsifier may be added to the compound A. As the emulsifier, a nonionic emulsifier or a cationic emulsifier is preferably used in terms of obtaining the high quality dyed materials.

EXAMPLES

Hereinafter, the present invention will be described specifically by way of Examples. In the below mentioned Examples, all % s mean weight % s, unless otherwise noted.

First, the evaluation methods used in the present invention will be explained below.

(1) Anti-fibrillation Property

As a system for examining the anti-fibrillation effect, JIS-L-0849 was used, and the whitening degree was evaluated by a color fastness test method when the fabrics were subjected to rubbing. Moreover, it is preferable that a test fabric sample (woven fabric) is used so that the effect easily can be determined.

In this test, by using a NIPPON GAKUJYUTU SINNKOKAI type tester for color fastness to rubbing, test fabric samples (white fabrics (cotton shirting)) dyed with a direct dye or an acid dye were subjected to rubbing 100 times in a wet state under a 200 g weight.

The whitening degree of the dyed test sample fabrics was determined by using a discoloration grey scale. The results were evaluated by the following five criteria.

Grade 1: much whitening (much fibrillation) is observed

Grade 2: whitening is observed

Grade 3: whitening is slightly observed

Grade 4: whitening is hardly observed

Grade 5: whitening is not observed (no fibrillation occurs)

Moreover, in general, there is no problem if the fabric is evaluated as the grade 3 or more. However, the fabric of the grade 4 or more is desired.

(2) Touch Property

The touch property of the cellulose fabric that was subjected to the anti-fibrillation treatment was examined by touching the fabric with a finger to determine its feeling.

The feeling was evaluated on the following rating.

1: rough and hard

2: slightly poor

3: slightly good

4: soft and good

5: soft and extremely good (3) Dyeing Method

In the following Examples 10 and above, experiments were carried out by using reactive dyes or direct dyes which have the lowest efficiency of dyeing fiber materials among the dyes for cellulose fibers.

[Synthesizing Method]

Synthesis Example 1

100 parts by weight of ethylene glycol was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 298 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The obtained compound was a mixture containing about 70% of principal objective substance (expressed by the following chemical formula 4) that was a reactant in which 1 mole ethylene glycol was reacted with two moles epichlorohydrin, about 20% of by-product (expressed by the following chemical formula 5) that was a reactant in which the above-mentioned principal objective substance was reacted with one mole epichlorohydrin, and about 10% of by-product (expressed by the following chemical formula 6) that was a reactant in which the above-mentioned principal objective substance was reacted with a further two moles of epichlorohydrin.

(Chemical Formula 4)

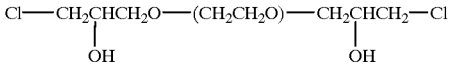

(R of the above-mentioned chemical formula (compound A): —$CH_2CH_2$—, m=0, k=2)

(Chemical Formula 5)

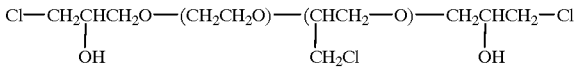

(R of the above-mentioned chemical formula (compound A): —$CH_2CH_2$—, equivalent mixture of compounds of m=0 and m=1, k=2)

(Chemical Formula 6)

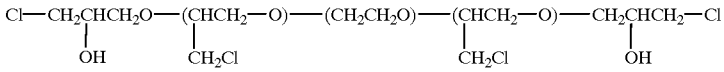

(R of the above-mentioned chemical formula (compound A): —$CH_2CH_2$—, m=1, k=2)

Synthesis Example 2

100 parts by weight of glycerin was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 200 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The compound expressed by the following chemical formula 7 was obtained.

(Chemical Formula 7)

R of the above-mentioned chemical formula (compound A): —$CH_2CH(OH)CH_2$—, m=0, k=2

Synthesis Example 3

100 parts by weight of glycerin was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 300 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The obtained compound was a mixture comprising 25% of compound expressed by the following chemical formula 8 and 75% of compound expressed by the following chemical formula 9.

(Chemical Formula 8)

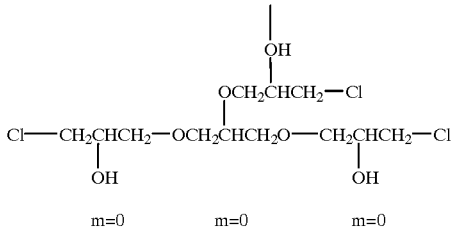

R of the above-mentioned chemical formula (compound A); —$CH_2CHCH_2$—, m=0, k=3

(Chemical Formula 9)

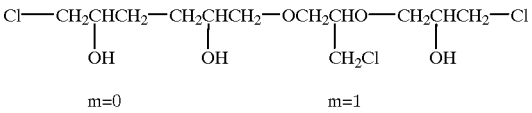

(R of the above-mentioned chemical formula (compound A): —$CH_2CH(OH)CH_2$—, m=0, 1, k=2)

Synthesis Example 4

100 parts by weight of polyethyleneglycolal (PEG-200) was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 92.5 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The compound expressed by the following chemical formula 10 was obtained.

Hereinafter, in the following chemical formulae, R of the compound A expressed by the above-mentioned chemical formula, m and k will be expressed.

(Chemical Formula 10)

R; —$(CH_2CH_2O)_3$—$CH_2CH_2$— m=1,k=2

Synthesis Example 5

100 parts by weight of sorbitol was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 305 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The compound expressed by the following chemical formula 11 was obtained.

(Chemical Formula 11)

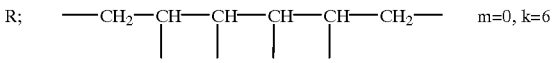

Synthesis Example 6

100 parts by weight of bisphenol S and 74 parts by weight of epichlorohydrin were placed in a flask equipped with a stirring stick, a condenser, a thermometer and a dropping device, and the temperature was raised to 70° C. with stirring. As catalyst, 0.1 parts by weight of boron trifluoride was added to the flask, stirred and mixed. Thereafter, the mixture was aged for 2 hours at 80° C. and 0.1 parts by weight of sodium hydroxide was added to neutralize so as to adjust to pH 7.

The compound expressed by the following chemical formula 12 was obtained.

(Chemical Formula 12)

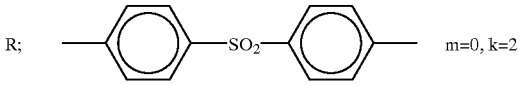

Synthesis Example 7

100 parts by weight of dimethylol propionic acid and 137 parts by weight of epichlorohydrin were placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, the mixture was aged for 2 hours at 80° C. and 0.1 parts by weight of sodium hydroxide was added to neutralize so as to adjust to pH 7.

The compound expressed by the following chemical formula 13 was obtained.

(Chemical Formula 13)

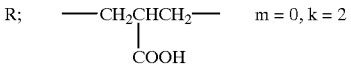

Synthesis Example 8

100 parts by weight of triethanolamine was placed in a flask equipped with a stirring stick, a condenser, a thermometer and a dropping device, and the temperature was raised to 70° C. with stirring. When the temperature was elevated to 70 to 80° C., 186 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The compound expressed by the following chemical formula 14 was obtained.

(Chemical Formula 14)

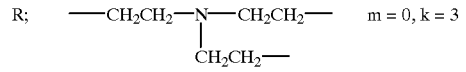

Synthesis Example 9

100 parts by weight of ethylenediamine ether with ethylene oxide-propylene oxide block copolymer (ethylene oxide addition 20%: molecular weight; 2,000) was placed in a flask equipped with a stirring stick, a condenser, a thermometer and a dropping device, and the temperature was raised to 70° C. with stirring. As a catalyst, 0.1 parts by weight of boron trifluoride was added to the flask, stirred and mixed. Thereafter, when the temperature was elevated to 70 to 80° C., 18.5 parts by weight of epichlorohydrin was added dropwise. After the dropping was completed, the mixture was aged for 2 hours at 80° C. and 0.1 parts by weight of sodium hydroxide was added to neutralize so as to adjust to pH 7.

The compound expressed by the following chemical formula 15 was obtained.

(Chemical Formula 15)

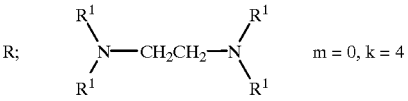

wherein $R^1$ of the above-mentioned chemical formula 15 is expressed by the following chemical formula 16.

(Chemical Formula 16)

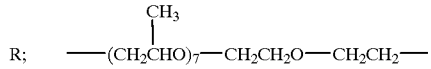

In the following Examples, refined cellulose fibers, which are the most easily fibrillated of all cellulose fibers, were used.

Example 1

(Treating Bath)

A treating bath was prepared by mixing 5 parts by weight of the compound (modifier) obtained in the Synthesis Example 1, 4 parts by weight of emulsifier (20 mole adduct of stearyl alcohol ethylene oxide) and 100 parts by weight of water, and then adding 2 parts by weight of sodium hydroxide to the mixture.

(Treating Method)

A plain weave Tencel fabric (trade name of Coutaulds Fibers, a refined cellulose) (10 gram) having a basis weight of 150 g/m$^2$ was immersed in the above-obtained aqueous solution (temperature: 25° C.), squeezed with rolls at squeezing rate of 100%, and then heated at 120° C. for 5 minutes by using a tenter. The fabric was washed in hot water, acetate (90 wt. % aqueous solution) was added to the fabric to neutralize, and then the fabric was washed in water. Thereafter, the fabric was dried in air. Thus, a test fabric sample was made. The amount of the modifiers attached to the test fabric sample was 0.2 weight %. Table 1 shows the results of the fibrillation property test of the obtained test fabric sample.

Example 2

(Treating Bath)

A treating bath was prepared by mixing 5 parts by weight of the compound obtained in the Synthesis Example 2, 4 parts by weight of emulsifier (20 mole adduct of stearyl alcohol ethylene oxide) and 100 parts by weight of water, and then adding 2 parts by weight of sodium hydroxide to the mixture.

The same treating method and dyeing method as Example 1 were carried out. Table 1 shows the results of the fibrillation property test of the obtained test fabric sample.

Example 3

(Treating Bath)

A treating bath was prepared by mixing 5 parts by weight of the compound obtained in the Synthesis Example 3, 4 parts by weight of emulsifier (20 mole adduct of stearyl alcohol ethylene oxide) and 100 parts by weight of water, and then adding 2.5 parts by weight of sodium hydroxide to the mixture.

The same treating method as Example 1 was carried out. Table 1 shows the results of the fibrillation property test of the obtained test fabric sample.

Example 4

(Treating Bath)

A treating bath was prepared by mixing 5 parts by weight of the compound obtained in the Synthesis Example 4, 4 parts by weight of emulsifier (20 mole adduct of stearyl alcohol ethylene oxide) and 100 parts by weight of water, and then adding 3.5 parts by weight of sodium hydroxide to the mixture.

The same treating method as Example 1 was carried out. Table 1 shows the results of the fibrillation property test of the obtained test fabric sample.

Example 5

(Treating Bath)

A treating bath was prepared by mixing 5 parts by weight of the compound obtained in the Synthesis Example 5, 4 parts by weight of emulsifier (20 mole adduct of stearyl alcohol ethylene oxide) and 100 parts by weight of water, and then adding 10 parts by weight of sodium hydroxide to the mixture.

The same treating method as Example 1 was carried out. Table 1 shows the results of the fibrillation property test of the obtained test fabric sample.

Example 6

(Treating Bath)

A treating bath was prepared by mixing 5 parts by weight of the compound obtained in the Synthesis Example 6, 4 parts by weight of emulsifier (20 mole adduct of stearyl alcohol ethylene oxide) and 100 parts by weight of water, and then adding 2.5 parts by weight of sodium hydroxide to the mixture.

The same treating method as Example 1 was carried out. Table 1 shows the results of the fibrillation property test of the obtained test fabric sample.

Example 7

(Treating Bath)

A treating bath was prepared by mixing 5 parts by weight of the compound obtained in the Synthesis Example 7, 4 parts by weight of emulsifier (20 adduct of mole stearyl alcohol ethylene oxide) and 100 parts by weight of water, and then adding 2 parts by weight of sodium hydroxide to the mixture.

The same treating method as Example 1 was carried out. Table 1 shows the results of the fibrillation property test of the obtained test fabric sample.

Example 8

(Treating Bath)

A treating bath was prepared by mixing 5 parts by weight of the compound obtained in the Synthesis Example 8, 4 parts by weight of emulsifier (20 mole adduct of stearyl alcohol ethylene oxide) and 100 parts by weight of water, and then adding 3 parts by weight of sodium hydroxide to the mixture.

The same treating method as Example 1 was carried out. Table 1 shows the results of the fibrillation property test of the obtained test fabric sample.

Example 9

(Treating Bath)

A treating bath was prepared by mixing 5 parts by weight of the compound obtained in the Synthesis Example 9, 4 parts by weight of emulsifier (20 mole adduct of stearyl alcohol ethylene oxide) and 100 parts by weight of water, and then adding 0.5 parts by weight of sodium hydroxide to the mixture.

The same treating method as Example 1 was carried out. Table 1 shows the results of the fibrillation property test of the obtained test fabric sample.

Comparative Example 1

100 parts by weight of aqueous solution consisting of 30 parts by weight of methylenebis ((3-chloro-2-hydroxypropyl) dimethylammonium chloride), 10 parts by weight of its dimer (hereinafter, "C1" will be used for the mixture of a monomer and a dimer) and 60 parts by weight of water was placed in a container. Next, 30 parts by weight of sodium hydroxide solution (50 weight %) was added to the container. This solution was further diluted with water by 10 times. A plain weave Tencel fabric (10 grams) having a basis weight of 150 g/m$^2$ was immersed in the diluted aqueous solution (temperature: 25° C.), squeezed with rolls at squeezing rate of 100%, and heated at 120° C. for 5 minutes by using a tenter. The fabric was then washed in hot water, added by acetate (90 wt. % aqueous solution) so as to neutralize, and then was washed in water. Thereafter, the fabric was dried in air and made to be a test fabric sample. When the nitrogen amount of the obtained test fabric sample was determined by a macro Kjeldahl method, it was 0.2 weight %. Table 1 shows the results of the fibrillation property test of the obtained test fabric sample.

Comparative Example 2

100 parts by weight of aqueous solution consisting of 30 parts by weight of tetramethylenebis ((3-chloro-2-hydroxypropyl) dimethylammonium chloride), 10 parts by weight of its dimer (hereinafter, "C14" will be used for a mixture of a monomer and a dimer) and 60 parts by weight of water was placed in a container. Next, 30 parts by weight of sodium hydroxide solution (50 weight %) was added in the container. This solution was further diluted with water by 10 times. A plain weave Tencel fabric (10 grams) having a basis weight of 150 g/m$^2$ was immersed in the diluted aqueous solution (temperature: 25° C.), squeezed with rolls at squeezing rate of 100%, and heated at 120° C. for 5 minutes by using a tenter. The fabric was then washed in hot water, added by acetate (90 wt % aqueous solution) so as to neutralize and then was washed in water. Thereafter, the fabric was dried in air and made to be a test fabric sample. When the nitrogen amount in the obtained test fabric was determined by a macro Kjeldahl method, it was 0.2 weight %. Table 1 shows the results of the fibrillation property test of the obtained test fabric sample.

Comparative Example 3

Plain weave Tencel fabric (basis weight: 150 g/m$^2$) was immersed and treated in an aqueous solution including 3.0% of aqueous solution of 50% glutaraldehyde and 1% of aqueous solution of 85% phosphoric acid. The treated fabric was heated at 120° C. for 5 minutes to dryness by using a tenter. Next, the fabric was washed in highly diluted aqueous ammonia and squeezed to dryness.

Table 1 shows the results of the fibrillation properties of the test fabric samples.

TABLE 1

| | Anti-fibrillation effect | Touch |
|---|---|---|
| Not treated | Grade 1 | 5 |
| Comparative Example 1 | Grade 4 | 2 |
| Example 1 | Grade 4 | 5 |
| Example 2 | Grade 5 | 5 |
| Example 3 | Grade 5 | 5 |
| Example 4 | Grade 5 | 5 |
| Example 5 | Grade 5 | 4 |
| Example 6 | Grade 4 | 5 |
| Example 7 | Grade 5 | 4 |
| Example 8 | Grade 5 | 5 |
| Example 9 | Grade 4 | 5 |
| Comparative Example 2 | Grade 2 | 5 |
| Comparative Example 3 | Grade 4 | 1 |

As is apparent from Examples 1 to 9 in Table 1, the compound A of the present invention shows the excellent result. On the other hand, in Comparative Example 1, the fibrillation could be prevented but the feeling was deteriorated and thus the features of refined cellulose fibers were damaged. Furthermore, in the compound having a carbon number of 14 or more as in Comparative Example 2, the fibrillation effect tends to be reduced. In addition, in Comparative Example 3, the fibrillation could be prevented but the touch was deteriorated.

In the above-mentioned Examples, the refined cellulose, which is the most easily fibrillated in all the cellulose fibers, was used. However, in the present invention, cellulose is not limited to this alone. The present invention can use regenerated fibers such as viscose rayon (rayon, polynosic, polyviscose, etc.), cuprammonium rayon (Cupra, Bemberg, etc.) fibers, or the like; semisynthetic fibers such as cellulose acetate (acetate, diacetate, triacetate) fibers, promix (polyacrylonitrile-milk protein graft fiber), or the like; or natural fibers such as cotton, linen; or the like. Besides the above, fibers including —OH group, for example, vinylon [$—(CH_2—CHOH)_n—$, wherein n denotes a positive integer to represent a repetitive unit number of the polymer] and polychlal [a copolymer of $—(CH_2—CHCl)_n—$and$—(CH_2—CHOH)_n—$, wherein n denotes a positive integer to represent a repeating unit number of the polymer], or the like, are usable.

Example 10

(Treating Bath of Deep Dyeing Pretreatment)

A treating bath was prepared by mixing 5 parts by weight of the compound obtained in the Synthesis Example 1, 4 parts by weight of emulsifier (20 mole adduct of stearyl alcohol ethylene oxide) and 100 parts by weight of water, and then adding 2 parts by weight of sodium hydroxide to the mixture.

(Treating Method of Deep Dyeing Pretreatment)

A plain weave Tencel fabric (trade name of Coutaulds Fibers, a refined cellulose) (10 gram) having a basis weight of 150 g/m$^2$ was immersed in the above-mentioned aqueous solution (temperature: 25° C.), squeezed with rolls at squeezing rate of 100% , and heated at 120° C. for 5 minutes by using a tenter. The fabric was then washed in hot water, added by acetate (90 wt. % aqueous solution) so as to neutralize, and then washed in water. Thus, the deep dyeing pretreatment fabric was made.

(Dyeing Method)

Dyeing was carried out as follows: the above-obtained deep dyeing pretreated fabric was immersed in a bath including dye and 50 g/liter of mirabilite anhydride. The bath was heated to 60° C. Five minutes after heating, alkali was added and retained for 60 minutes so as to carry out a dyeing.

In this method, as the reactive dye, C.I. Reactive Yellow 17 (1% on the weight of fiber (o. w. f. will be referred to for abbreviation, hereinafter), C.I. Reactive Red 21 (1% o.w.f.) and C.I. Reactive Blue 19 (1% o.w.f.) were used. Furthermore, as the alkali, 20 g/liter of soda ash was used. Table 2 shows the results of the dyeing property test of the obtained test fabric sample.

Moreover, an evenly dyed material was obtained.

Example 11

(Treating Bath of Deep Dyeing Pretreatment)

A treating bath was prepared by mixing 5 parts by weight of the compound obtained in the Synthesizing Example 2, 4 parts by weight of emulsifier (20 mole adduct of stearyl alcohol ethylene oxide) and 100 parts by weight of water, and then adding 2 parts by weight of sodium hydroxide to the mixture.

The same treating method and dyeing method as Example 10 were carried out. Table 2 shows the results of the dyeing property test of the obtained test fabric sample.

Moreover, an evenly dyed material was obtained.

Example 12

(Treating Bath of Deep Dyeing Pretreatment)

A treating bath was prepared by mixing 5 parts by weight of the compound obtained in the Synthesizing Example 3, 4 parts by weight of emulsifier (20 mole adduct of stearyl alcohol ethylene oxide) and 100 parts by weight of water, and then adding 2 parts by weight of sodium hydroxide to the mixture.

The same treating method and dyeing method as Example 10 were employed. Table 2 shows the results of the dyeing property test of the obtained test fabric sample.

Moreover, an evenly dyed material was obtained.

Comparative Example 4

(Dyeing Method)

Dyeing was carried out as follows: a plain weave Tencel fabric was immersed in a bath including dye and mirabilite anhydride in an amount of 50 g/liter. The bath was heated to 60° C. Five minutes after heating, alkali was added and retained for 60 minutes so as to carry out a dyeing.

In this method, as the reactive dye, C.I. Reactive Yellow 17 (1% o.w.f), C.I. Reactive Red 21 (1% o.w.f.) and C.I. Reactive Blue 19 (1% o.w.f.) were used. Furthermore, as the alkali, 20 g/liter of soda ash was used. Table 2 shows the results of the dyeing property test of the obtained test fabric sample.

Example 13

(Treating Bath for Deep Dyeing Pretreatment)

A treating bath was prepared by mixing 5 parts by weight of the compound obtained in the Synthesizing Example 1, 4 parts by weight of emulsifier (20 mole adduct of stearyl alcohol ethylene oxide) and 100 parts by weight of water, and then adding 2 parts by weight of sodium hydroxide to the mixture.

(Treating Method)

A plain weave Tencel fabric (trade name of Coutaulds Fibers, a refined cellulose fiber) (10 gram) having a basis weight of 150 g/m$^2$ was immersed in the above-mentioned aqueous solution (temperature: 25° C.), squeezed with rolls at squeezing rate of 100%, heated at 120° C. for 5 minutes by using a tenter. The fabric was washed in hot water, acetate added (90 wt. % aqueous solution) so as to neutralize, and then washed in water. Thus, the deep dyeing pretreatment fabric was made.

(Dyeing Method)

Dyeing was carried out as follows: the above-obtained deep dyeing pretreatment fabric was immersed in a bath including dye and mirabilite anhydride in an amount of 10 g/liter. The bath was heated to 98° C. and retained for 60 minutes so as to carry out a dyeing.

In this method, as the reactive dye, C.I. Reactive Yellow 17(1% on the weight of fiber (o. w. f.), C.I. Reactive Red 21 (1% o.w.f.) and C.I. Reactive Blue 19 (1% o.w.f) were used. Table 2 shows the results of the dyeing property test of the obtained test fabric sample.

Moreover, an evenly dyed material was obtained.

Example 14

(Treating Bath of Deep Dyeing Pretreatment)

A treating bath was prepared by mixing 5 parts by weight of the compound obtained in the Synthesizing Example 2, 4 parts by weight of emulsifier (20 mole adduct of stearyl alcohol ethylene oxide) and 100 parts by weight of water, and then adding 2 parts by weight of sodium hydroxide to the mixture. The same treating method and dyeing method as Example 10 were carried out. Table 2 shows the results of dyeing property test of the obtained test fabric.

Moreover, an evenly dyed material was obtained.

Example 15

(Treating Bath of Deep Dyeing Pretreatment)

A treating bath was prepared by mixing 5 parts by weight of the compound obtained in the Synthesizing Example 3, 4 parts by weight of emulsifier (20 mole adduct of stearyl alcohol ethylene oxide) and 100 parts by weight of water, and then adding 2 parts by weight of sodium hydroxide to the mixture. The same treating method and dyeing method as Example 10 were carried out. Table 2 shows the results of dyeing property test of the obtained test fabric.

Moreover, an evenly dyed material was obtained.

Comparative Example 5

(Dyeing Method)

Dyeing was carried out as follows: 10 grams of plain weave Tencel fabric (trade name of Coutaulds Fibers, a refined cellulose) having a basis weight of 150 g/m$^2$ was immersed in a bath including dye and mirabilite anhydride in an amount of 10 g/liter. The bath was heated to 98° C. and retained for 60 minutes so as to carry out a dyeing.

In this method, as the direct dye, C.I. Direct Yellow 105 (0.5% o.w.f.), C.I. Direct Red 80 (0.5% o.w.f.) and C.I. Direct Blue 199 (0.5% o.w.f.) were used.

(Evaluation Method)

The dyed fabric of Examples 10 to 12, the dyed fabric of Comparative Example 4, the dyed fabric of Examples 13 to 15 and the dyed fabric of Comparative Example 5 were evaluated for the color tones by using a colorimeter (CCM system: SICOMU 20 produced by Sumika Chemical Analysis Service Ltd.). The dyed concentration of the dyed fabric obtained in Comparative Example was 100 as a reference, and the concentration ratios of the dyed fabrics of Examples were evaluated and compared. In other words, when the concentration ratio of the dyed fabric of each Example is 100% or more, it can be judged that the deep dyeing efficiency was obtained.

Table 2 shows the results of the dyeing test with respect to the dyed fabric obtained in Examples and Comparative Examples.

TABLE 2

Results of the dyeing property

| | Concentration ratio (%) |
|---|---|
| Example 10 | 113 |
| Example 11 | 112 |
| Example 12 | 115 |

TABLE 2-continued

| Results of the dyeing property | |
|---|---|
| | Concentration ratio (%) |
| Comparative Example 4 | 100 |
| Example 13 | 111 |
| Example 14 | 112 |
| Example 15 | 112 |
| Comparative Example 5 | 100 |

As is apparent from Table 2, the results of Examples 10 to 15 show that the compound A of the present invention has the deep dyeing effect.

In the above-mentioned Examples, reactive dye and direct dye, which have the lowest dyeing rate to the fabric material among the cellulose dyeing, were used. However, the present invention is not limited to this alone, and a vat dye, a sulphur dye, a naphthol dye, or the like, can be used. Moreover, as the fabric material, the refined cellulose was used. However, the present invention was not limited to this alone, and a cotton fiber, viscose rayon (rayon, polynosic, polyviscose, or the like), cuprammonium rayon (regenerated cellulose fiber such as Cupra, etc.), natural cellulose fibers such as linen, or the like, are applicable.

The invention may be embodied in other specific forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A method of modifying refined solvent-spun cellulose fibers, wherein fibrillation of the refined cellulose fibers is prevented, the method comprising:

bringing a fixing amount of compound A, expressed by the following chemical formula (Chemical Formula 1)

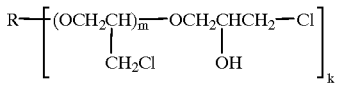

wherein R denotes an organic group selected from the group consisting of a hydrocarbon group, an alkanolamine group, an aromatic group and a polyoxyalkylene adduct; m denotes a positive integer of 0 to 3 and can be represented by a plurality of values; and k denotes a positive integer of 2 to 6, into contact with cellulose fibers in an aqueous phase in the presence of an alkali metal compound, wherein an added amount of the alkali metal compound is 1.1 to 2.5 times moles with respect to the molecular number of the chlorohydrin group positioned at the terminal end of the compound A resulting in;

chemically bonding compound A to the refined cellulose fibers such that they are covalently bonded to one another; and, crosslinking the refined cellulose fibers by two or more chlorohydrin groups included in each molecule of the compound A at the molecular structure level.

2. The modification method according to claim 1, wherein said compound A is in an aqueous composition in a concentration of 1 to 30 parts by weight with respect to 100 parts by weight of water.

3. The modification method according to claim 1, which is selected from the group consisting of an immersing method including a room temperature standing method and a heat stirring method; a padding method including a pad-roll method, a calendar method, an ink jet printing method, a pad dry cure method or a pad steam method; a textile printing method; a spray method; and a cold batch method.

4. The modification method according to claim 1, wherein said alkali metal compound is an alkali metal hydroxide.

5. The modification method according to claim 4, wherein said alkali metal hydroxide is at least one selected from the group consisting of sodium hydroxide (NaOH) and potassium hydroxide (KOH).

6. The method of modifying refined cellulose fibers according to claim 1, wherein the fixing amount of the modifier expressed by said chemical formula (compound A) with respect to the cellulose fiber is in the range from 0.05 to 10 weight %.

7. The method of modifying refined cellulose fibers according to claim 6, wherein the fixing amount of the modifier expressed by said chemical formula (compound A) with respect to the cellulose fiber is in the range from 0.1 to 8 weight %.

8. The method of modifying refined cellulose fibers according to claim 7, wherein the fixing amount of the modifier expressed by said chemical formula (compound A) with respect to the cellulose fiber is in the range from 0.2 to 5 weight %.

9. The method of modifying refined cellulose fibers according to claim 1, wherein R of said chemical formula (compound A) is selected from the group consisting of a hydrocarbon group that is a residue after glycerin, sorbitol, a polymer of not more than a decamer of polyethylene glycols that are reacted with each other, a triethanolamine group, a diethanolamine group, a cresol group, a bisphenol A group and a bisphenol S group.

* * * * *